US006224434B1

(12) United States Patent
Varney et al.

(10) Patent No.: US 6,224,434 B1
(45) Date of Patent: May 1, 2001

(54) PUMP JET WITH AXIAL DIRECTIONAL FLOW CONTROL DEVICE FOR THRUST MODULATION

(75) Inventors: A. Michael Varney, Sewall's Point; John D. Martino, Longwood, both of FL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/391,288

(22) Filed: Sep. 7, 1999

(51) Int. Cl.[7] ..... B63H 11/00
(52) U.S. Cl. ..... 440/38; 440/89
(58) Field of Search ..... 440/88, 89, 38; 60/221; 416/93 R, 93 A

(56) References Cited

U.S. PATENT DOCUMENTS

| | | | |
|---|---|---|---|
| 2,213,610 | 9/1940 | Ronning | 115/17 |
| 3,754,837 | 8/1973 | Shimanckas | 416/93 |
| 3,763,817 | 10/1973 | Francis | 115/6.1 |
| 4,023,353 | 5/1977 | Hall | 60/221 |
| 4,240,251 | 12/1980 | Fuller | 60/221 |
| 4,274,254 * | 6/1981 | Jansen et al. | 60/39.03 |
| 4,631,032 | 12/1986 | Nishida | 440/47 |
| 4,902,254 | 2/1990 | Chas | 440/38 |
| 4,929,200 | 5/1990 | Guezou et al. | 440/38 |
| 5,251,436 | 10/1993 | Brogan | 60/254 |

FOREIGN PATENT DOCUMENTS

| | | |
|---|---|---|
| 2-144293 | 4/1990 | (JP) . |
| 1279-910 | 12/1986 | (SU) . |
| 1497-109 | 7/1989 | (SU) . |

* cited by examiner

*Primary Examiner*—Stephen Avila
(74) *Attorney, Agent, or Firm*—Dennis M. Flaherty

(57) ABSTRACT

A pump jet in which the axial flow of water through the device is controlled by bleeding exhaust gas into the pump jet water stream, thereby producing a thrust loss. The addition of gas into the primary pump jet water flow stream reduces the effective flow density of the exit media, thereby reducing the exit momentum (and thrust) produced by the pump jet. The thrust modulation device can be actuated using any conventional electrical or mechanical actuation subsystem via a knob or lever positioned near the throttle control.

26 Claims, 4 Drawing Sheets

PUMP JET WITH AXIAL DIRECTIONAL FLOW CONTROL DEVICE FOR THRUST MODULATION

FIELD OF THE INVENTION

This invention generally relates to pump jets used with outboard motors or in inboard/outboard or stern drive units of boats and other vehicles. In particular, the invention relates to pump jets in which exhaust gas from the outboard motor is directed through the pump jet and discharged into the water stream surrounding the pump jet.

BACKGROUND OF THE INVENTION

In one type of conventional outboard motor, a propeller is driven by a powerhead to propel a boat through water. Most large outboard motors of this type inject the exhaust gas stream under water in order to reduce engine noise and increase propulsive thrust.

In a typical configuration shown in FIG. 1, the gas exhausted from the powerhead 10 flows downwardly through an exhaust channel 12 and exits the motor rearwardly through the propeller 14. This type of motor is referred to as an exhaust-through-hub (ETH) motor.

Another type of conventional outboard motor has an axial-flow pump jet system driven by the powerhead. In a pump jet system, an impeller or rotor is mounted (e.g., spline fitted) directly on the propeller output shaft in place of the propeller. There are typically no modifications to the drive train, cooling or sealing components. A ducted housing surrounds the rotor. Such a system has the advantages of reducing hazards to swimmers in the vicinity of the motor, protecting the rotating elements from interference with and damage by foreign objects in the water, and improving the efficiency and performance of the propulsion system. Another benefit inherent with the pump jet is a directed jet of water that results in greater steering response.

U.S. Pat. No. 5,325,662 discloses a pump jet in which the exhaust gas discharged from the outboard motor is ducted downwardly through the central body of the motor and around a rotor shaft. An annular exhaust channel is formed in the rotor hub for receiving the exhaust gas and projecting it rearwardly of the motor. A cavity in the stator hub provides a plenum chamber for receiving the exhaust gas. Exhaust gas flows from the cavity of the stator hub to at least one hollow stator vane which serves as an exhaust pipe. In the case of multiple hollow stator vanes, the flow in the stator hub is split into multiple streams. Each stream of exhaust gas passes through a respective hollow stator vane. Discharge ports are formed in the stator housing for discharging exhaust gas into the water stream surrounding the stator housing. This arrangement will be referred to herein as an exhaust-through-vane (ETV) configuration.

The volumetric flow through an axial-flow pump jet device produces the propulsive thrust forces necessary to propel a boat or other watercraft. Generally, as the motor rpm approaches full throttle, the thrust forces are also reaching maximum values, provided that the boat velocity is low, as is typically encountered in work boats and pontoon boats. Often it is desirable to modulate the thrust of a pump jet while maintaining the rpm at near wide-open throttle, particularly if a quicker response is possible. In order to achieve this modulation effect at full rpm, it is necessary to control the axial flow through the pump jet device.

SUMMARY OF THE INVENTION

The present invention is a pump jet in which the axial flow of water through the device is controlled by bleeding exhaust gas into the pump jet water stream, thereby producing a thrust loss. In accordance with the preferred embodiment of the invention, an ETV-type pump jet is provided with means for bleeding exhaust gas from the plenum cavity in the stator hub directly into the exit flow stream. This addition of gas into the primary pump jet water flow stream reduces the effective flow density of the exit media, thereby reducing the exit momentum (and thrust) produced by the pump jet. The thrust modulation device can be actuated using any conventional electrical or mechanical actuation subsystem via a knob or lever positioned near the throttle control.

The invention also encompasses a method for operating an ETV pump jet comprising the steps of: activating a motor of an ETV pump jet to cause a rotor to impel a stream of water through the volume between a stator hub and a stator housing, and to cause exhaust gas to pass through a cavity in the stator hub and a hollow stator vane; and bleeding exhaust gas from said cavity inside the stator hub into said water stream.

DETAILED DESCRIPTION OF THE PREFERRED EMBODIMENTS

Figure 1:
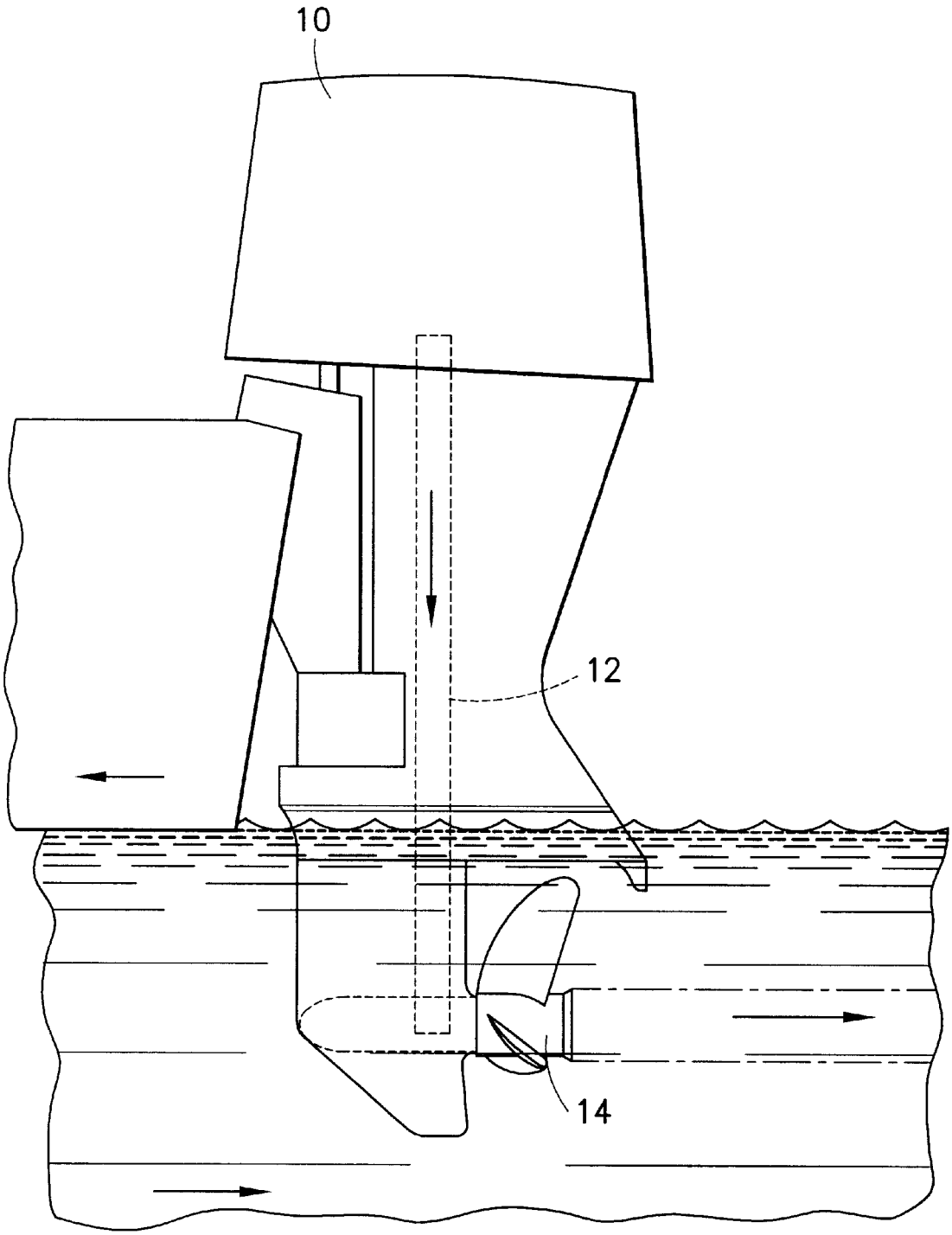
FIG. 1 PRIOR ART
FIG. 1 is a schematic view of a prior art ETH motor with a propeller.
Figure 2:
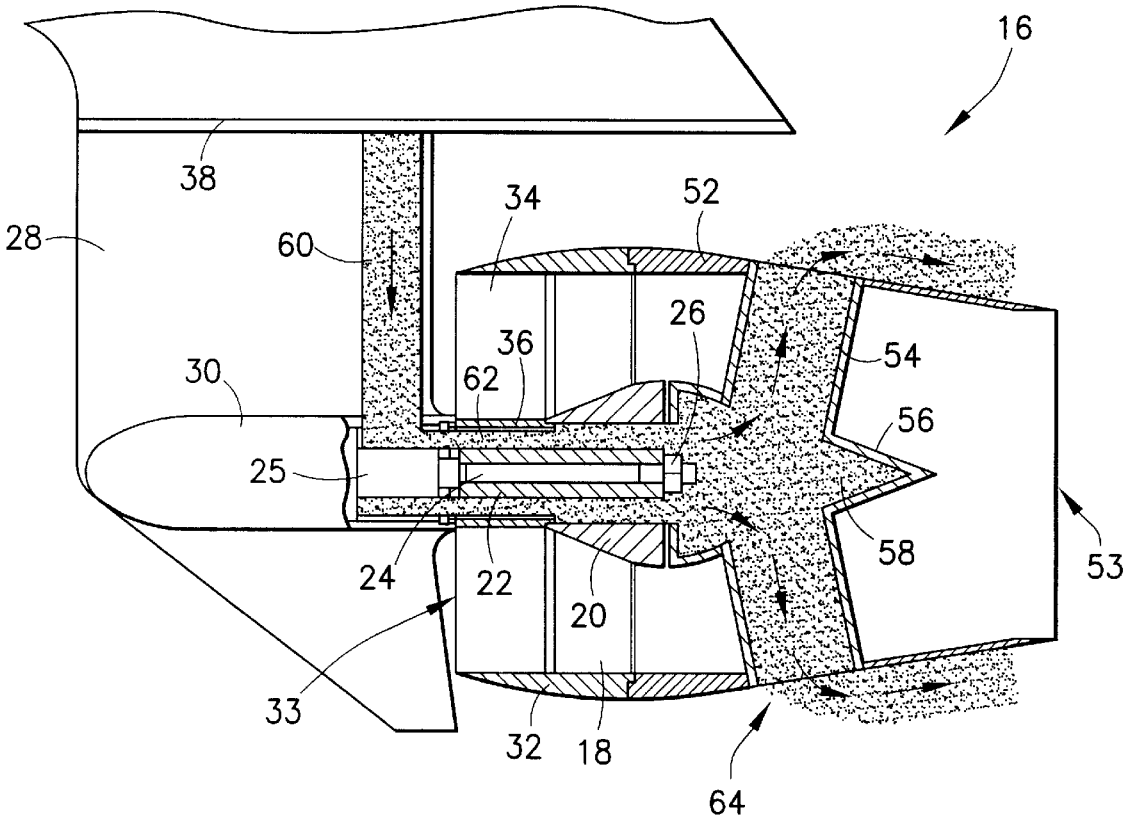
FIG.2 PRIOR ART
FIG. 2 is a partial sectional view of an ETV pump jet having exhaust streams discharged through at least two stator vanes.

The preferred embodiment of the invention is an outboard motor having a pump jet 16 of the ETV type shown in FIG. 2. The pump jet includes a rotor comprising a plurality of blades 18 extending radially outward from an outer rotor hub 20. The outer rotor hub 20 is securely mounted on an inner rotor hub 22. The rotor and inner rotor hub are assembled prior to installation. During pump jet installation, this one-piece rotor assembly is inserted onto one end of a propeller shaft 24 and secured to the shaft by a nut 26. The other end of the propeller shaft is rotatably mounted in a bearing (not shown) which is housed in propeller shaft bearing housing 25. Inner rotor hub 22 is connected to outer rotor hub 20 by means of radial struts, which are not visible in the partially sectional view of FIG. 2.

In conventional fashion, the powerhead 10 drives the propeller shaft 24 to rotate via a drive shaft and gears, neither of which are shown in FIG. 2. The drive shaft extends inside the lower housing unit 28, while the gears are arranged inside the gear case 30. Rotation of the propeller shaft in turn causes the rotor assembly to rotate. During rotation in forward gear, the angled blades 18 of the rotor impel water axially rearward to produce a forward thrust. In reverse gear, a reverse thrust is produced.

The rotor assembly is surrounded by a non-rotating rotor housing 32. The rotor housing 32 is part of a one-piece rotor housing assembly, which also comprises a plurality of inlet vanes 34 and an inlet vane hub 36. Each inlet vane 34 is joined at one end to the inlet vane hub 36 and at the other end to the rotor housing 32. The inlet vanes direct water flow into the blades 18 of the rotor. The inlet vanes also block debris, sea creatures or human limbs from contacting the rotating blades of the rotor.

Figure 3:
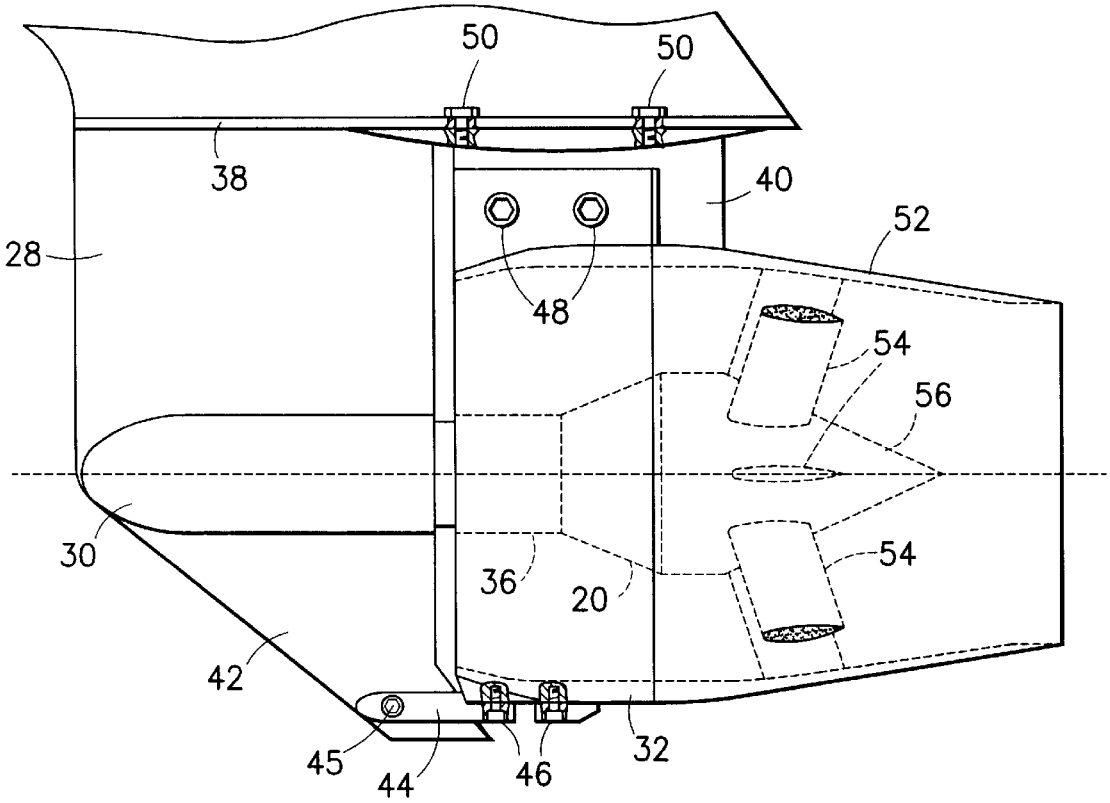
FIG.3 PRIOR ART
FIG. 3 is a side elevational view showing the manner of attachment of the pump jet of FIG. 2 to an outboard motor.

During pump jet installation, the rotor housing assembly is installed prior to installation of the rotor assembly. The inlet vane hub 36 is inserted into the downstream end of the gear case 30. Referring to FIG. 3, the rotor housing assembly is joined to an anti-cavitation plate 38 by means of an upper bracket 40 and is joined to skeg 42 by means of a clamp 44. Screw 45 squeezes the clamp 44 onto the skeg 42. Screws 46 secure the clamp 44 to the rotor housing 32. Screws 48 and bolts 50 attach the upper bracket 40 to the anti-cavitation plate 38.

Referring again to FIG. 2, the rotor housing 32, which has an inlet 33 for the intake of water, forms the upstream portion of the shroud which fully encloses the pump jet. The rearward portion of the shroud comprises a stator housing 52 which has an outlet 53 for the water propelled rearward by the rotor blades 18. The stator housing 52 has an upstream edge which form fits with the downstream edge of the rotor housing 32. Installation of a pump jet involves three steps: (1) attach the rotor housing to the anti-cavitation plate and skeg; (2) install the rotor on the propellor shaft; and (3) attach the stator housing to the rotor housing by means of screws (not shown in FIG. 2). The stator housing 52 has a generally conical portion which decreases in internal diameter in the downstream direction. The minimum internal diameter of stator housing 52 is preferably located at the outlet 53.

The stator housing 52 is part of a one-piece stator housing assembly, which also comprises a plurality of stator vanes 54 and a stator hub 56. Each stator vane 54 is joined at one end to the stator hub 56 and at the other end to the stator housing 52. The stator vanes convert rotational energy imparted to the water flow by the rotor blades into axial flow energy at the outlet of the stator housing 52. One or more of the stator vanes 54 is hollow. Similarly, an internal cavity in the stator hub 56 forms a plenum cavity 58, which is in flow communication with each hollow stator vane. Nut 26 extends into plenum cavity 58 in stator hub 56.

The exhaust gas from the powerhead 10 flows downwardly through an exhaust channel 60. The lower end of the exhaust channel 60 is in flow communication with a hub exhaust channel 62 which channels the exhaust stream rearward through the hub. The hub exhaust channel 62 is an annular space, which is bounded internally by the propeller shaft bearing housing 25 and the inner rotor hub 22, and externally by the wall of the gear case 30, the inlet vane hub 36 and the outer rotor hub 20. The exhaust stream flows from the hub exhaust channel 62 to the plenum cavity 58 in stator hub 56, and then into the hollow stator vanes 54 which communicate with the plenum cavity. Preferably at least a portion of the stator hub 56 is conical in shape. The exhaust stream in each hollow stator vane flows the length of the stator vane and discharges from a respective exhaust port 64 into the water stream surrounding the stator housing 52.

Figure 4:
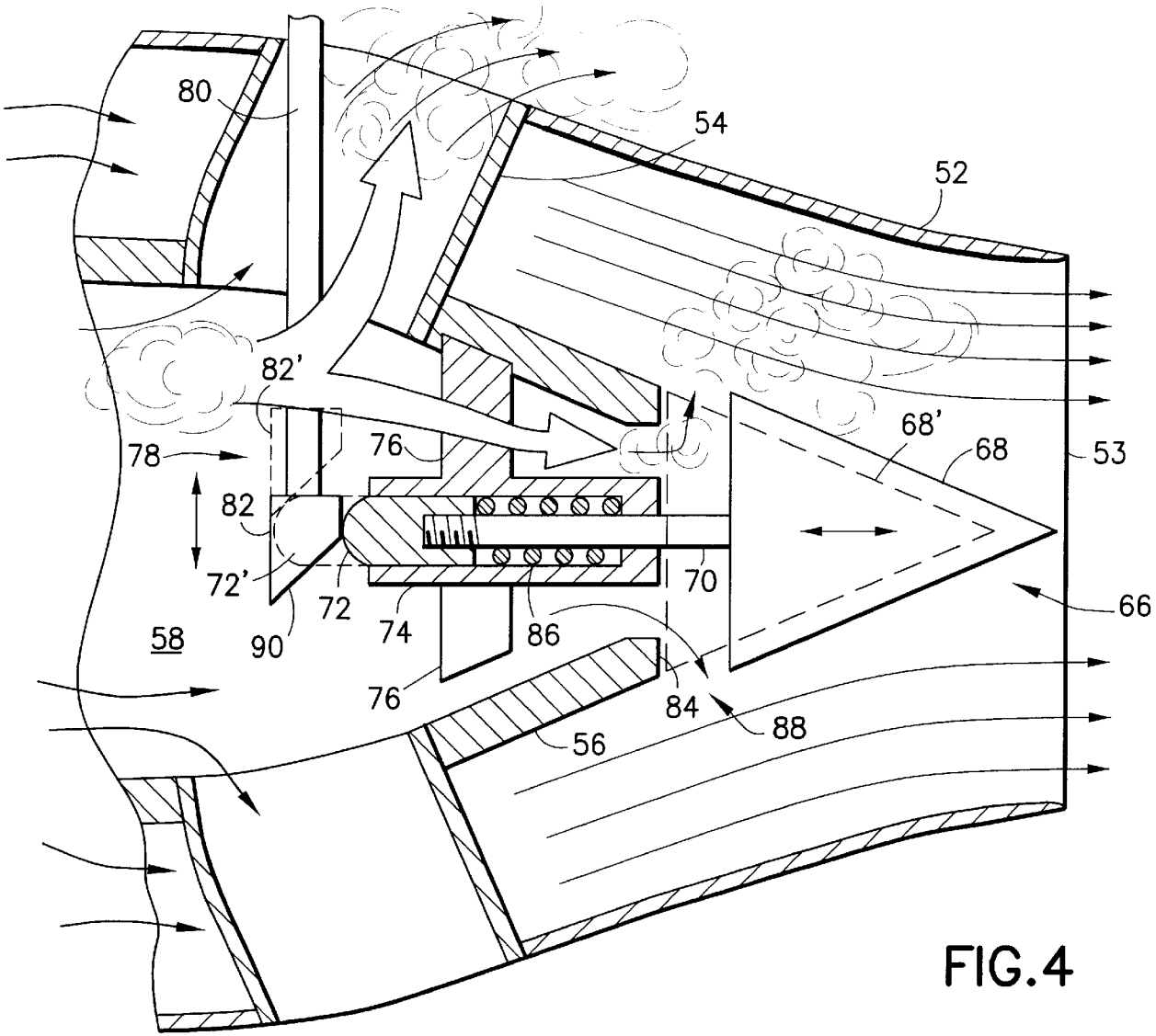
FIG. 4 is a partial sectional view of an ETV pump jet of the type shown in FIG. 2 having an axial flow control device for bleeding exhaust gas into the exit flow water stream.

In accordance with the preferred embodiment of he invention shown in FIG. 4, exhaust gas is bled into the exit flow water stream from the plenum cavity. The terminal section of the stator hub is replaced by a flow control valve 66 which can be operated by the boat operator. In the preferred embodiment, the flow control valve 66 is slidable between open and closed positions, and comprises a conical valve head 68, a valve stem 70, a valve piston 72, a cylinder 74 and a compression spring 86. One end of the valve stem 70 is coupled to the valve piston 72. The valve head 68 is mounted on the other end of the valve stem 70. The valve piston 72 is axially slidable inside the cylinder 74. One end of the cylinder 74 acts as a bearing for the sliding valve stem 70. The cylinder 74 is supported in a position coaxial with the pump jet centerline by a plurality (e.g., three) of radial struts 76.

In accordance with the preferred embodiment, the flow control valve 66 is actuated by a valve actuator assembly 78 comprising a displaceable actuator rod 80 having an actuator 82 mounted on its distal end. Although not shown in FIG. 4, the actuator rod 80 is preferably supported by a pair of bearings which allow the rod to displace along its longitudinal axis in response to manipulation of the proximal end of the rod by the boat operator. Preferably, the proximal end of the actuator rod has a knob, lever or handle (not shown) mounted thereon which is readily accessible to the boat operator. Although FIG. 4 depicts the actuator rod 80 as passing through one of the hollow stator vanes 52, a person skilled in the art will appreciate that the disclosed design could be modified to allow the rod 80 to pass through a separate opening in the stator housing, instead of through a hollow stator vane, that separate opening also acting as a bearing for the sliding actuator rod.

In accordance with the preferred embodiment, the actuator assembly is displaceable between upper and lower positions, the upper actuator position corresponding to the valve closed position and the lower actuator position corresponding to the valve open position. The upper position of the actuator is shown by dashed lines 82', the closed position of the valve head is shown by dashed lines 68' and the valve piston position corresponding to the valve head closed position is shown by dashed line 72' in FIG. 4; the lower position of the actuator 82, the open position of the valve head 68' and the position of the valve piston 72 corresponding to the valve head open position are shown by solid lines in FIG. 4.

In the closed position, an annular contact face of the valve head 68 abuts an annular valve seat 84, the opposing surfaces forming a seal preventing the escape of exhaust gas from the plenum cavity 58 into the exit flow water stream. In the closed position shown by dashed lines 68' in FIG. 4, the valve head is held against the valve seat 84 by the action of the compression spring 86. In the closed position, the boat can be operated at full throttle without thrust modulation. When the valve head is displaced rearward, the annular contact face of the valve head 68 moves away from the annular valve seat 84, forming a gap 88 through which exhaust gas from the plenum cavity 58 flows into the exit flow water stream. In the open position, the thrust can be modulated by controlling the width of the gap 88, i.e., the greater the gap width, then the greater the thrust loss will be.

In the preferred embodiment depicted in FIG. 4, the flow control valve is actuated by displacing the actuator assembly downward from the upper position (dashed lines) to the lower position (solid lines). During this downward displacement, the actuator 82 pushes the valve piston 72 rearward (rightward in FIG. 4), causing the valve head 68 to move away from the valve seat 84.

In accordance with one preferred embodiment of the invention, the actuator 82 has a planar camming surface 90 which is disposed to bear against a rounded protruding end of the valve piston 72. The camming surface is inclined at an acute angle (e.g., 45°) relative to the pump jet centerline. When the planar camming surface 90 is in contact with the rounded end of the valve piston 72, the width of gap 88 will increase linearly as a function of the downward displacement of actuator. However, a person skilled in the art will readily appreciate that the camming surface need not be planar and may instead be a concave curved surface.

In order to restore full thrust, the boat operator causes the actuator 82 to displace from the lower position (solid lines) to the upper position (dashed lines) shown in FIG. 4. As the point of contact between the actuator 82 and the valve piston 72 changes during upward displacement of the actuator, the compression spring 86 urges the piston forward (leftward in FIG. 4), causing the valve head 68 to return to the closed position.

In accordance with the preferred embodiment shown in FIG. 4, the conical outer surface of the valve head 68 functions as part of the stator hub when the flow control valve is closed. In accordance with an alternative embodiment, a valve assembly is arranged inside a stator hub having one or more exhaust gas outlets. In the rearmost valve head position, the valve head closes the exhaust gas outlets. In response to manipulation of an actuator by the boat operator, the valve head moves forward to uncover the exhaust gas outlets, allowing the exhaust gas in the plenum cavity to escape into the exit flow water stream. For example, in order to accomplish forward displacement of the valve head, the valve piston is provided with an extension having a transverse arm which is contacted by an actuator. In this case, the camming surface of the actuator is arranged to cam the arm forward (instead of rearward as in the embodiment shown in FIG. 4) when the actuator is displaced downwardly, thereby causing the flow control valve to open.

The invention has application in both outboard drive units and inboard/outboard or stern drive units for watercraft and other vehicles. A propulsor of a stern drive unit is typically mounted to the stern or transom of a boat hull via a transom mount assembly or bracket. The shaft on which the pump jet rotor is mounted is driven to rotate by an engine mounted inside the boat via conventional gear assemblies mounted outside the boat.

While the invention has been described with reference to preferred embodiments, it will be understood by those skilled in the art that various changes may be made and equivalents may be substituted for elements thereof without departing from the scope of the invention. In particular, a person skilled in the art will have little difficulty designing functionally equivalent devices for actuating the flow control valve. For example, it will be obvious to a skilled artisan that the change in position of the valve piston could be actuated hydraulically or pneumatically, e.g., by closing the open end of the cylinder 74 and then supplying liquid or gas to a chamber defined by the newly closed end of the cylinder and the forward end of the valve piston. The boat operator may then actuate opening of the flow control valve by activating a pump which supplies liquid or gas to the aforementioned chamber in the cylinder. In accordance with a further alternative, valve opening could be actuated electrically, e.g., by coupling the valve piston to a solenoid, the state of the solenoid being controlled by the boat operator. Also, numerous alternative devices could be readily designed for opening the flow control valve mechanically. For example, a rack and pinion arrangement could be employed to convert rotation (instead of downward displacement) of an actuator shaft into rearward (or forward) displacement of the valve piston. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

As used in the claims, the term "marine engine" includes both inboard and outboard motors.

What is claimed is:

1. A pump jet apparatus for a marine engine, comprising:

a rotor assembly for impelling water rearward in a forward thrust mode, said rotor assembly comprising a rotor hub having a channel for receiving exhaust gas from an engine;

a rotor housing surrounding said rotor assembly and having an inlet and an outlet;

a stator housing coupled to and positioned rearwardly of said rotor housing and having an inlet and an outlet for water flow, said inlet of said stator housing being in flow communication with said outlet of said rotor housing;

a stator hub positioned rearwardly of said rotor hub and inside said stator housing, said stator hub comprising an exhaust plenum in flow communication with said channel in said rotor hub and an opening in flow communication with said exhaust plenum, said opening being situated forward of said stator housing outlet and rearward of said rotor assembly;

a flow control valve arranged to cover and uncover said opening in said stator hub in closed and open states respectively, wherein exhaust gas flows into a volume external to said stator hub and internal to said stator housing at a point forward of said stator housing outlet via said opening when said flow control valve is in said open state and does not flow through said opening when said flow control valve is in said closed state; and an actuator assembly for actuating said flow control valve to change from said closed state to said open state.

2. The pump jet apparatus as recited in claim 1, further comprising a hollow stator vane, wherein said exhaust outlet is in flow communication with said exhaust plenum via said hollow stator vane.

3. The pump jet apparatus as recited in claim 1, wherein said flow control valve comprises a valve head which covers said opening in said stator hub when said flow control valve is in said closed state.

4. The pump jet apparatus as recited in claim 1, wherein said flow control valve further comprises a valve piston connected to said valve head by a valve stem and slidably arranged inside a cylinder.

5. The pump jet apparatus as recited in claim 4, wherein said valve piston has an end which protrudes from said cylinder when said flow control valve is in said closed state, and said actuator assembly comprises an actuator which cooperates with said protruding end of said valve piston during movement of said actuator from a first position to a second position to cause said flow control valve to change state from said closed state to said open state.

6. The pump jet apparatus as recited in claim 5, wherein said actuator has a camming surface disposed to cam said valve piston during said movement of said actuator from said first position to said second position.

7. The pump jet apparatus as recited in claim 5, wherein said movement of said actuator is translation.

8. The pump jet apparatus as recited in claim 4, wherein said flow control valve further comprises a compression spring which urges said flow control valve toward said closed state.

9. The pump jet apparatus as recited in claim 1, wherein said actuator assembly penetrates said stator hub and said stator housing.

10. A pump jet apparatus for a marine engine, comprising:

a rotor assembly comprising a rotating hub having an exhaust channel for receiving exhaust gas from an engine;

a non-rotating hub having an exhaust channel for receiving exhaust gas from said exhaust channel of said rotating hub;

a housing surrounding said hubs and having an inlet and an outlet for water flows, said housing outlet being situated to the rear of said exhaust channel of said non-rotating hub;

a flow control valve having open and closed states and disposed so that exhaust gas from said exhaust channel is released directly into a volume external to said hubs and internal to said housing when said flow control valve is in said open state and is not released into said volume when said flow control valve is in said closed state, said exhaust gas being released at a location forward of said housing outlet and rearward of said rotor assembly; and an actuator assembly for actuating said flow control valve to change from said closed state to said open state, wherein said actuator assembly penetrates said hub and said housing.

11. The pump jet apparatus as recited in claim 10, wherein said housing comprises a rotor housing and a stator housing which are in flow communication, and said hub comprises a rotor hub and a stator hub.

12. The pump jet apparatus as recited in claim 11, further comprising an exhaust outlet in said stator housing and in flow communication with said exhaust channel.

13. The pump jet apparatus as recited in claim 12, further comprising a hollow stator vane, wherein said exhaust outlet is in flow communication with said exhaust channel via said hollow stator vane.

14. The pump jet apparatus as recited in claim 11, wherein said stator hub comprises an opening, and said flow control valve comprises a valve head which covers said opening in said stator hub when said flow control valve is in said closed state.

15. The pump jet apparatus as recited in claim 10, wherein said actuator assembly penetrates said hub and said housing.

16. The pump jet apparatus as recited in claim 14, wherein said actuator assembly comprises an actuator which cooperates with said flow control valve during movement of said actuator from a first actuator position to a second actuator position to cause said valve head to move from a first valve head position covering said opening to a second valve head position uncovering said opening.

17. The pump jet apparatus as recited in claim 16, wherein said actuator assembly is arranged so that said actuator translates from said first actuator position to said second actuator position.

18. A method for modulating thrust of a propulsion system comprising a powerhead and a pump jet apparatus, comprising the steps of:

submerging a pump jet apparatus in water;

operating the propulsion system in a mode in which an impeller of the pump jet apparatus impels water rearward through a volume external to a hub and internal to a housing and discharges impelled water out an outlet of the housing, the discharged water producing forward thrust; and during operation, changing the forward thrust being produced by releasing exhaust gas from the powerhead into said volume at a point forward of the housing outlet and rearward of the impeller.

19. An apparatus for propelling a watercraft, comprising:

a powerhead which produces exhaust gas;

a powerhead exhaust channel in flow communication with said powerhead for receiving exhaust gas therefrom;

a hub having a hub exhaust channel for receiving exhaust gas from said powerhead exhaust channel;

a housing surrounding said hub and having an inlet and an outlet for water flow, said housing outlet being situated to the rear of said hub exhaust channel;

a flow control valve having open and closed states and disposed so that exhaust gas from said exhaust channel is released directly into a volume external to said hub and internal to said housing when said flow control valve is in said open state and is not released into said volume when said flow control valve is in said closed state, said exhaust gas being released at a location forward of said housing outlet and rearward of said rotor assembly; and an actuator assembly for actuating said flow control valve to change from said closed state to said open state, wherein said actuator assembly penetrates said hub and said housing.

20. The apparatus as recited in claim 19, wherein said housing comprises a rotor housing and a stator housing which are in flow communication, and said hub comprises a rotor hub and a stator hub.

21. The pump jet apparatus as recited in claim 20, further comprising an exhaust outlet in said stator housing and in flow communication with said exhaust channel.

22. A pump jet apparatus for a marine engine, comprising:

a rotor assembly comprising a rotating hub having an exhaust channel for receiving exhaust gas from an engine;

a non-rotating hub having an exhaust channel for receiving exhaust gas from said exhaust channel of said rotating hub;

a housing surrounding said hubs and having an inlet and an outlet for water flows, said housing outlet being situated to the rear of said exhaust channel of said non-rotating hub;

means for bleeding exhaust gas from said exhaust channel into a volume external to said hub and internal to said housing, said bled exhaust gas entering said volume at a location which is forward of said housing outlet and rearward of said rotor assembly.

23. The pump jet apparatus as recited in claim 22, further comprising an actuator assembly for actuating said bleeding means, wherein said actuator assembly penetrates said hub and said housing.

24. The pump jet apparatus as recited in claim 22, wherein said housing comprises a rotor housing and a stator housing which are in flow communication, and said hub comprises a rotor hub and a stator hub.

25. The pump jet apparatus as recited in claim 24, further comprising an exhaust outlet in said stator housing and in flow communication with said exhaust channel.

26. The pump jet apparatus as recited in claim 25, further comprising a hollow stator vane, wherein said exhaust outlet is in flow communication with said exhaust channel via said hollow stator vane.

* * * * *